US009140071B2

(12) United States Patent
Vo et al.

(10) Patent No.: US 9,140,071 B2
(45) Date of Patent: Sep. 22, 2015

(54) APPARATUS AND METHOD FOR RETAINING INSERTS OF A ROLLING CONE DRILL BIT

(71) Applicant: NATIONAL OILWELL DHT, L.P., Conroe, TX (US)

(72) Inventors: Thang Vo, Houston, TX (US); Tjandra Sukendro, Conroe, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 308 days.

(21) Appl. No.: 13/685,348

(22) Filed: Nov. 26, 2012

(65) Prior Publication Data

US 2014/0144709 A1 May 29, 2014

(51) Int. Cl.

| | |
|---|---|
| ***E21B 10/16*** | (2006.01) |
| ***B24D 18/00*** | (2006.01) |
| ***E21B 10/52*** | (2006.01) |
| ***E21B 10/56*** | (2006.01) |

(52) U.S. Cl.

CPC ..... *E21B 10/16* (2013.01); *B24D 18/0009* (2013.01); *E21B 10/52* (2013.01); *E21B 10/56* (2013.01)

(58) Field of Classification Search

CPC ..... E21B 10/52; E21B 10/56; E21B 10/16; E21B 10/46; E21B 2010/562; E21B 18/00; E21B 18/0009

See application file for complete search history.

(56) References Cited

U.S. PATENT DOCUMENTS

| | | | |
|---|---|---|---|
| 3,389,761 | A | 6/1968 | Ott |
| 3,495,670 | A | 2/1970 | Ditson |
| 3,581,835 | A | 6/1971 | Stebley |
| 4,047,583 | A | 9/1977 | Dyer |
| 4,368,788 | A | 1/1983 | Drake |
| 4,372,404 | A | 2/1983 | Drake |
| 4,398,952 | A | 8/1983 | Drake |
| 4,592,252 | A | 6/1986 | Ecer |
| 4,597,456 | A | 7/1986 | Ecer |
| 4,604,106 | A | 8/1986 | Hall |
| 4,629,373 | A | 12/1986 | Hall |
| 4,694,918 | A | 9/1987 | Hall |

(Continued)

FOREIGN PATENT DOCUMENTS

| | | | |
|---|---|---|---|
| AU | 2007201463 | A1 | 4/2007 |
| WO | 97/35091 | A1 | 9/1997 |

OTHER PUBLICATIONS

Nixon, M.S., Walter, J.C., "Unique Rock Bit Cutter Fabrication Technology Provides Bit Design, Performance, and Reliability Breakthroughs," 68th Annual Technical Conference and Exhibition of the Society of Petroleum Engineers, Houston, Texas, Oct. 3-6, 1993, pp. 309-322 (SPE 26344) (14 p.).

(Continued)

*Primary Examiner* — Yong-Suk (Philip) Ro
(74) *Attorney, Agent, or Firm* — Conley Rose, P.C.

(57) ABSTRACT

An insert for a rolling cone drill bit includes a base portion having a central axis. The base portion is configured to be seated in a mating socket in a cone cutter of the rolling cone drill bit. In addition, the insert includes a cutting portion extending from the base portion. The base portion has a radially outer surface including a non-cylindrical axial retention feature configured to prevent the insert from moving axially out of the mating socket or a non-cylindrical torque holding feature configured to prevent the insert from rotating relative to the cone cutter.

23 Claims, 12 Drawing Sheets

(56) References Cited

U.S. PATENT DOCUMENTS

| | | | | |
|---|---|---|---|---|
| 4,811,801 | A | 3/1989 | Salesky et al. | |
| 5,172,779 | A | 12/1992 | Siracki et al. | |
| 5,421,423 | A * | 6/1995 | Huffstutler | 175/374 |
| 5,423,719 | A | 6/1995 | Jennings | |
| 5,766,394 | A | 6/1998 | Anderson et al. | |
| 5,967,245 | A | 10/1999 | Garcia et al. | |
| 5,967,248 | A | 10/1999 | Drake et al. | |
| 6,142,250 | A | 11/2000 | Griffin et al. | |
| 6,241,034 | B1 | 6/2001 | Steinke et al. | |
| 6,604,588 | B2 * | 8/2003 | Eyre et al. | 175/374 |
| 6,739,214 | B2 | 5/2004 | Griffin et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 7,036,613 | B2 | 5/2006 | Burr | |
| 7,757,789 | B2 * | 7/2010 | Yong et al. | 175/432 |
| 2010/0108401 | A1 | 5/2010 | Lanning et al. | |

OTHER PUBLICATIONS

PCT/US2013/071383 International Search Report and Written Opinion dated Oct. 9, 2014 (17 p.).

PCT/US2013/071383 Invitation to Pay Additional Fees and Partial International Search dated May 22, 2014 (5 p.).

* cited by examiner

APPARATUS AND METHOD FOR RETAINING INSERTS OF A ROLLING CONE DRILL BIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Disclosure

The invention relates generally to earth-boring bits used to drill a borehole for the ultimate recovery of oil, gas, or minerals. More particularly, the invention relates to rolling cone rock bits and to an improved cutting structure for such bits. Still more particularly, the invention relates to apparatus and methods for retaining inserts within the rolling cone cutters of a rolling cone bit.

2. Background Information

An earth-boring drill bit is connected to the lower end of a drill string and is rotated by rotating the drill string from the surface, with a downhole motor, or by both. With weight-on-bit (WOB) applied, the rotating drill bit engages the formation and proceeds to form a borehole along a predetermined path toward a target zone. The borehole formed in the drilling process will have a diameter generally equal to the diameter or "gage" of the drill bit. The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

In oil and gas drilling operations, costs are generally proportional to the length of time it takes to drill the borehole to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section-by-section. Once the drill string has been retrieved and the new bit installed, the bit must be lowered to the bottom of the borehole on the drill string, which again must be constructed section-by-section. This process, known as a "trip" of the drill string, requires considerable time, effort and expense. Since drilling costs are typically one the order of thousands of dollars per hour, it is desirable to employ drill bits which will drill faster and longer, and which are usable over a wider range of formation hardnesses.

One common type of earth-boring bit, referred to as a rolling cone or cutter bit, includes one or more rotatable cone cutters, each provided with a plurality of cutting elements. During drilling with WOB applied, the cone cutters roll and slide upon the bottom of the borehole as the bit is rotated, thereby enabling the cutting elements to engage and disintegrate the formation in its path. The borehole is formed as the cutting elements gouge and scrape or chip and crush the formation. The chips of formation are carried upward and out of the borehole by drilling fluid which is pumped downwardly through the drill pipe and out of the bit.

Cutting elements provided on the rolling cone cutters are typically one of two types—inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" or "insert" bits, while those having teeth formed from the cone material are commonly known as "milled tooth bits" or "steel tooth bits." The shape and positioning of the cutting elements (both teeth and inserts) upon the cone cutters greatly impact bit durability and ROP, and thus, are important to the success of a particular bit design.

Inserts in TCI bits are typically positioned in circumferential rows on the rolling cone cutters. Specifically, most insert bits include a radially outermost heel row of inserts positioned to cut the borehole sidewall, a gage row of inserts radially adjacent the heel row and positioned to cut the corner of the borehole, and multiple inner rows of inserts radially inward of the gage row and positioned to cut the bottom of the borehole. The inserts in the heel row, gage row, and inner rows can have a variety of different geometries.

As previously described, inserts are conventionally secured via interference fit within a mating socket or bore provided in the outer surface of a rolling cone cutter. Typically, the insert has a cylindrical base portion secured within an undersized cylindrical bore in the cone cutter, and a cutting portion for engaging the formation extending from the base portion and the surface of the cone cutter. However, during drilling operations, the inserts are subjected to significant loads and stress as they repeatedly impact the formation. Consequently, the inserts can be loosened relative to the cone cutter, or even worse, completely pop out of the corresponding bore in the cone cutter. If an insert is loosened, the insert may rotate relative to the cone cutter about its central axis. This can be particularly problematic in cases where the cutting portion of the insert is asymmetric and installed in the rolling cone cutter with a specific rotational orientation to enhance cutting effectiveness and efficiency. If an insert completely disengages the cone cutter, the cutting effectiveness and efficiency of the bit is likely to reduced. In both cases (i.e., loosened or lost inserts), ROP may suffer to an extent that replacement of the drill bit is necessary, thereby requiring a time consuming and expensive trip of the entire drillstring.

Accordingly, there remains a need in the art for a drill bit and inserts that provide a relatively high rate of penetration and footage drilled, yet be durable enough to withstand anticipated formation hardnesses. Such drill bits and cutting elements would be particularly well received if they offered the potential to reduce the likelihood of inserts being loosened or lost during drilling operations, thereby improving the drill bit's overall durability.

BRIEF SUMMARY OF THE DISCLOSURE

These and other needs in the art are addressed in one embodiment by an insert for a rolling cone drill bit. In an embodiment, the insert comprises a base portion having a central axis. The base portion is configured to be seated in a mating socket in a cone cutter of the rolling cone drill bit. In addition, the insert comprises a cutting portion extending from the base portion. The base portion has a radially outer surface including a non-cylindrical axial retention feature configured to prevent the insert from moving axially out of the mating socket or a non-cylindrical torque holding feature configured to prevent the insert from rotating relative to the cone cutter.

These and other needs in the art are addressed in another embodiment by an insert for a rolling cone drill bit. In an embodiment, the insert comprises a base portion having a central axis. The base portion is configured to be seated in a mating socket in a cone cutter of the rolling cone drill bit. In addition, the insert comprises a cutting portion extending from the base portion. The base portion has a radially outer surface including a non-cylindrical axial retention feature configured to prevent the insert from moving axially out of the mating socket and a non-cylindrical torque holding feature configured to prevent the insert from rotating relative to the cone cutter.

These and other needs in the art are addressed in another embodiment by a method for making a rolling cone drill bit. In an embodiment, the method comprises (a) fabricating a plurality of inserts. Each insert includes a base portion having a central axis and a cutting portion extending from the base portion. The base portion has a radially outer surface including a non-cylindrical axial retention feature or a non-cylindrical torque holding feature. In addition, the method comprises (b) positioning each insert in a mold assembly. The mold assembly includes a receptacle and a plurality of recesses extending from the receptacle. The cutting portion of each insert is seated in one of the recesses and the base portion of each insert extends into the receptacle. Further, the method comprises (c) filling the receptacle with a powdered metal. Still further, the method comprises (d) surrounding the base portion of each insert with the powdered metal. Moreover, the method comprises (e) forming a cone cutter including a cone body and the plurality of inserts extending from the cone body by compressing the powdered metal after (d). The method also comprises (f) mounting cone cutter to a journal of a bit body.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the disclosed embodiments of the disclosure, reference will now be made to the accompanying drawings in which.

DETAILED DESCRIPTION OF THE DISCLOSED EMBODIMENTS

Figure 1:
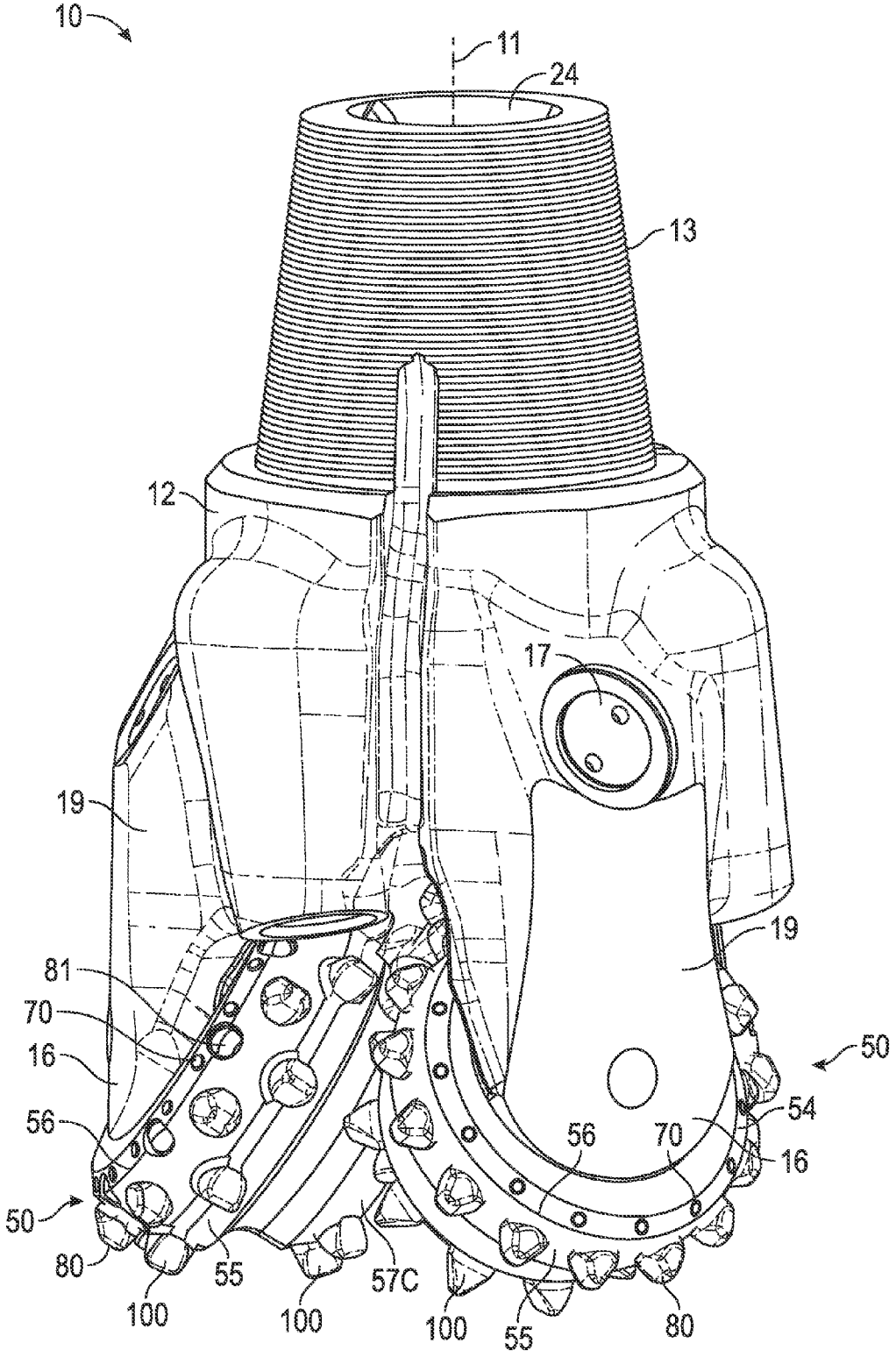
FIG. 1 is a perspective view of an embodiment of an earth-boring bit in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port, while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purpose of clarification, with "up", "upper", "upwardly" or "upstream" meaning toward the surface of the borehole and with "down", "lower", "downwardly" or "downstream" meaning toward the terminal end of the borehole, regardless of the borehole orientation.

Referring now to FIG. 1, an embodiment of a rolling cone drill bit 10 is shown. Bit 10 has a central axis 11 and includes a bit body 12 with an externally threaded pin 13 at its upper end and a plurality of rolling cone cutters 50 (two cutters 50 visible in FIG. 1) rotatably mounted on bearing shafts that depend from the bit body 12. In this embodiment, three rolling cone cutters 50 are rotatably mounted to bit body 12. Pin end 13 is adapted to secure bit 10 to a drill string (not shown). Bit body 12 is formed of three sections or legs 19 welded together and are generally symmetrical with respect to axis 11. Bit 10 has a predetermined gage diameter defined by the outermost reaches of cone cutters 50.

Bit 10 also includes a plurality of nozzles 18 (one shown in FIG. 1) and lubricant reservoirs 17 (one shown in FIG. 1). Nozzles 18 direct drilling fluid toward the bottom of the borehole and around cone cutters 50. Reservoirs 17 supply lubricant to the bearings that support each of the cone cutters 50. Bit legs 19 include a shirttail portion 16 that serves to protect the cone bearings and seals, described in more detail below, from formation cuttings and debris that seek to enter between leg 19 and its respective cone cutter 50 during drilling operations.

Figure 2:
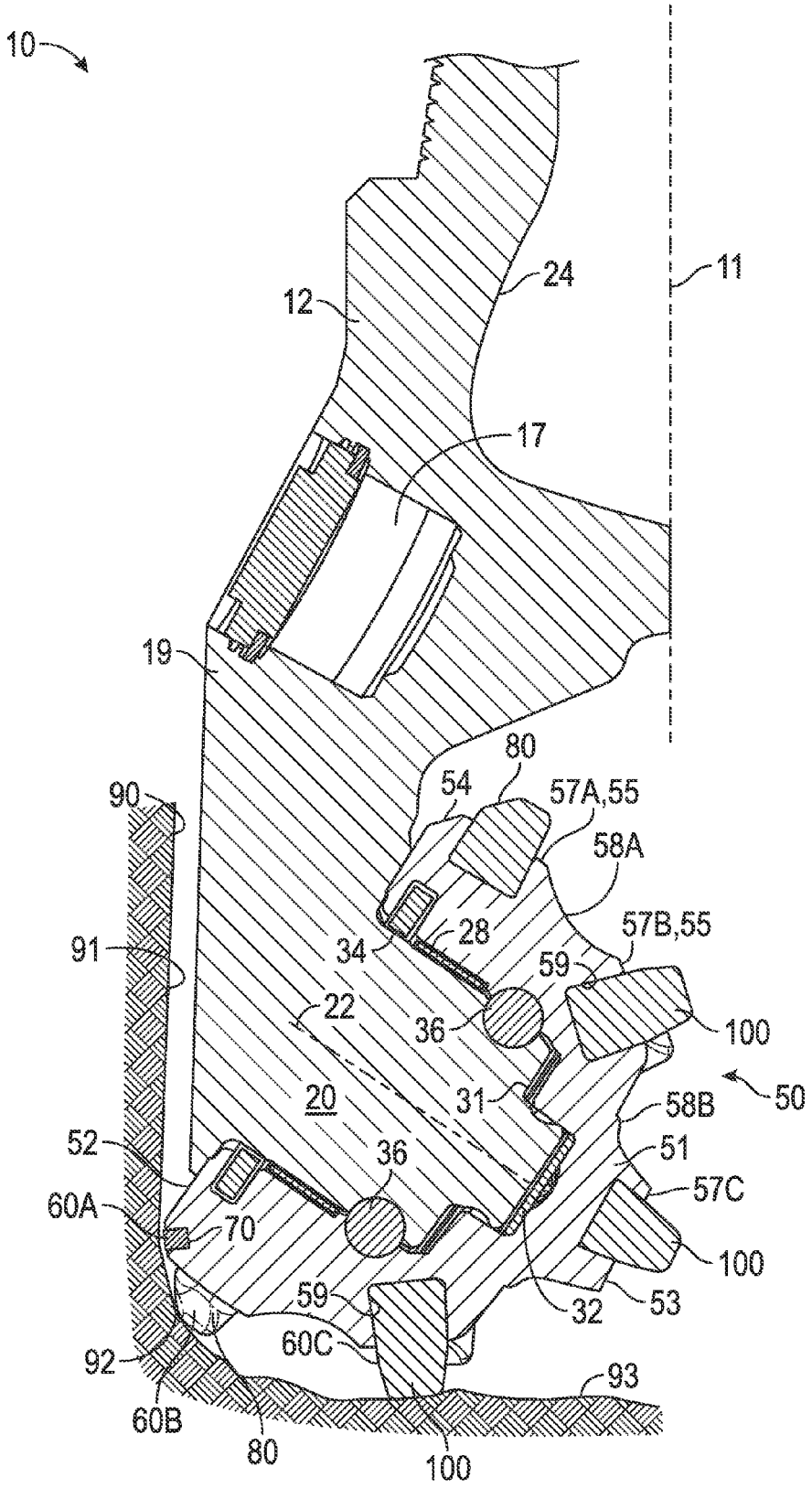
FIG. 2 is a partial cross-sectional view taken through one leg and one rolling cone cutter of the bit of FIG. 1.

Referring now to both FIGS. 1 and 2, each cone cutter 50 is rotatably mounted on a journal 20 extending radially inward at the lower end of one leg 19, and has a central axis of rotation 22 oriented generally downwardly and inwardly toward bit axis 11. During drilling operations, bit 10 is rotated about axis 11 in a cutting direction (clockwise direction looking downward at pin end 13 along axis 11) and each cone cutter 50 rotates about axis 22 in a cutting direction (counterclockwise direction looking at backface 52 along axis 22). Each cutter 50 is secured on its corresponding journal 20 with locking balls 26. In this embodiment, journal bearings 28, thrust washer 31, and thrust plug 32 are provided between each cone cutter 50 and journal 20 to absorb radial and axial thrusts. In other embodiments, roller bearings may be provided between each cone cutter 50 and associated journal pin 20 instead of journal bearings 28. In both journal bearing and roller bearing bits, lubricant is supplied from reservoir 17 to the bearings by apparatus and passageways that are omitted from the figures for clarity. The lubricant is sealed in the bearing structure, and drilling fluid excluded therefrom, with an annular seal 34. Drilling fluid is pumped from the surface through fluid passage 24 at pin end 13 and is circulated through an internal passageway (not shown) to nozzles 18 (FIG. 1). As best shown in FIG. 2, the borehole 90 created by bit 10 includes sidewall 91, corner 92 and bottom 93.

Referring still to FIGS. 1 and 2, each cone cutter 50 includes a body 51 and a plurality of wear resistant cutting elements mounted to body 51. Each cone body 51 includes a generally planar backface 52 and nose 53 opposite backface 52. Moving axially relative to cone axis 22 from backface 52 to nose 53, each cone body 51 further includes a generally frustoconical surface 54 and a generally conical surface 55 extending from frustoconical surface 54 to nose 53. As best shown in FIG. 1, frustoconical surface 54 and generally conical surface 55 intersect at an annular edge or shoulder 56. Although referred to herein as an "edge" or "shoulder," it should be understood that shoulder 56 may be contoured, such as by a radius, to various degrees such that shoulder 56 will define a contoured zone of convergence between surfaces 54, 55.

Surface 54 retains and supports cutting elements that contact, scrape, or ream the sidewall 9191 of the borehole as the cone cutters 50 rotate about the borehole bottom. Frustoconical surface 54 will be referred to herein as the "heel" surface of cone cutters 50, it being understood, however, that the same surface may be sometimes referred to by others in the art as the "gage" surface of a rolling cone cutter. Conical surface 55 retains and supports cutting elements that contact, gouge, or crush the borehole sidewall 91 and/or bottom 93 as the cone cutters 50 rotate about borehole 90. In particular, conical surface 55 is divided into a plurality of generally frustoconical regions 57*a, b, c*, generally referred to as "lands," that retain and support a plurality of cutting elements. Grooves 58*a, b* are formed in cone surface 55 between adjacent lands 57*a, b, c*. In this embodiment, shoulder 56 and land 57*a* each retain and support a plurality of cutting elements that contact, gouge, crush, or ream the borehole corner 92.

Referring still to FIGS. 1 and 2, cone cutters 50 include a plurality of wear-resistant cutting elements 70, 80, 81, 100 for engaging and cutting the sidewall 91, corner 92, and bottom 93 of borehole 90. The cutting elements are arranged in a plurality of axially spaced (relative to cone axis 22) circumferential rows. More specifically, as best shown in FIG. 2, each cone cutter 50 includes a circumferential heel row 60*a* of cutting elements 70 extending from heel surface 54, a circumferential gage row 60*b* of cutting elements 80 extending from land 57*a* of surface 55 axially adjacent shoulder 56, at least one circumferential inner row 60*c* of cutting elements 100 extending from land 60*c* of surface 55 between row 60*b* and nose 53, and at least one cutting element 100 extending from land 57*c* corresponding to nose 53. In this embodiment, select cone cutters 50 also include a nestled gage row 60*b*' of cutting elements 81 disposed along shoulder 56.

Referring still to FIG. 2, heel cutting elements 70 function to ream the borehole sidewall 91, and in this embodiment, are generally flat-topped elements, although alternative shapes and geometries may be employed. Gage cutting elements 80, 81 are designed to cut corner 92 of borehole 90. In other words, gage cutting elements 80, 81 cut a portion of sidewall 91 and borehole bottom 93. In this embodiment, gage cutting elements 80 have a cutting surface with a generally slanted chisel crest and gage cutting elements 81 have a dome-shaped semi-spherical cutting surface, although alternative shapes and geometries may be employed. Bottomhole cutting elements 100, also sometimes referred to as "inner row" cutting elements, function to cut the bottom 93 of borehole 90, but do not engage or cut corner 92 or sidewall 91. In particular, bottomhole cutting elements 100 disposed on noses 53 function to cut portions of the borehole bottom 93 that is otherwise left uncut by the other bottomhole cutting elements 100, and thus, are sometimes referred to as "ridge" cutting elements. In this embodiment, bottomhole cutting elements 100 have cutting surfaces with elongate chisel crests, although other shapes and geometries may be employed.

Although only one cone cutter 50 is shown in FIG. 2, the remaining cone cutters 50 are generally the same, the only difference being inclusion of gage cutting elements 81 and the axial spacing (relative to axis 22) of the bottomhole cutting elements 100. In particular, select, but not all, cone cutters 50 include gage cutting elements 81; and the axial spacing of bottomhole cutting elements 100 differs between the three cone cutters 50 to maximize borehole bottom coverage, and so as not to interfere with cutting elements 100 on the other cone cutters 50. Namely, to combat bit balling and to allow for larger cone cutters 50, bottomhole cutting elements 100 on adjacent rolling cone cutters 50 are often arranged to intermesh. As cutting elements 100 in an inner row 60*c* of one cone cutter 50 intermeshes between two rows 60*c* of cutting elements 100 or between a gage row 60*b* of gage cutting elements 80 and a row 60*c* of cutting elements 100, it dislodges formation packed between those two rows 60*c* or 60*b*, 60*c*. Intermesh of cutting elements 100 also allows the diameter of cone cutters 50 to be larger, providing for a larger bearing surface which results in a more durable cone cutters 50.

As will be described in more detail below, the cutting elements of each cone cutter 50 are preformed structures seated in mating receptacles or sockets formed in the corresponding cone body 51. More specifically, each cutting element 70, 80, 81, 100 has a base portion seated in a socket in the cone body 51 and a formation engaging cutting portion extending from the base portion and the cone body 51. Accordingly, cutting elements of each cone cutter 50 (e.g., cutting elements 70, 80, 81, 100) may also be described as "inserts." In addition, as used herein, the term "base portion" refers to the portion of a cutting element or insert disposed and secured within a socket or receptacle in a cone body, and the term "cutting portion" refers to the portion of a cutting element or insert that extends from the cone body and engages the formation during drilling. As will be described in more detail below, in this embodiment, the base portion of each cutting element 70, 80, 81, 100 includes retention features that prevent it from rotating relative to the corresponding cone cutter 51 and popping out of (i.e., disengaging) the corresponding cone cutter socket.

Figure 3:
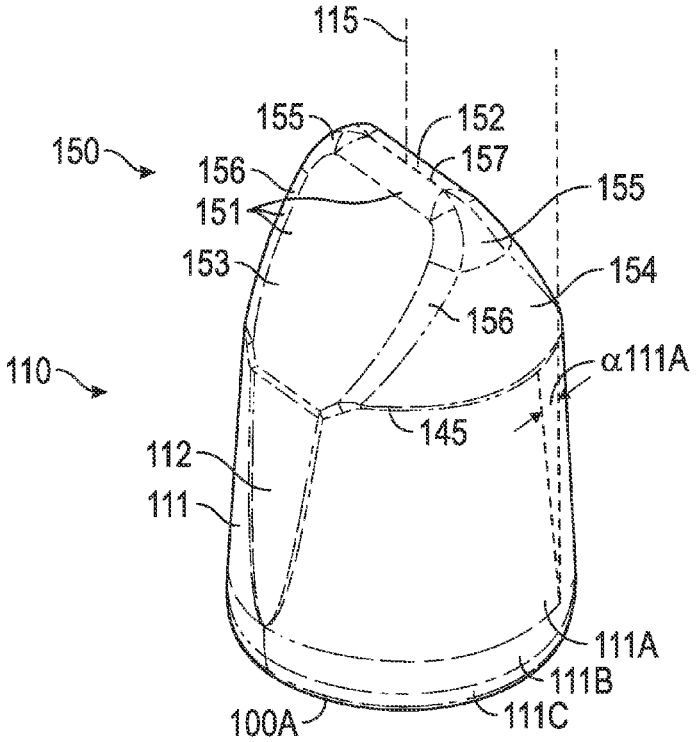
FIG. 3 is a perspective view of insert of the bit of FIG. 1.
Figure 4:
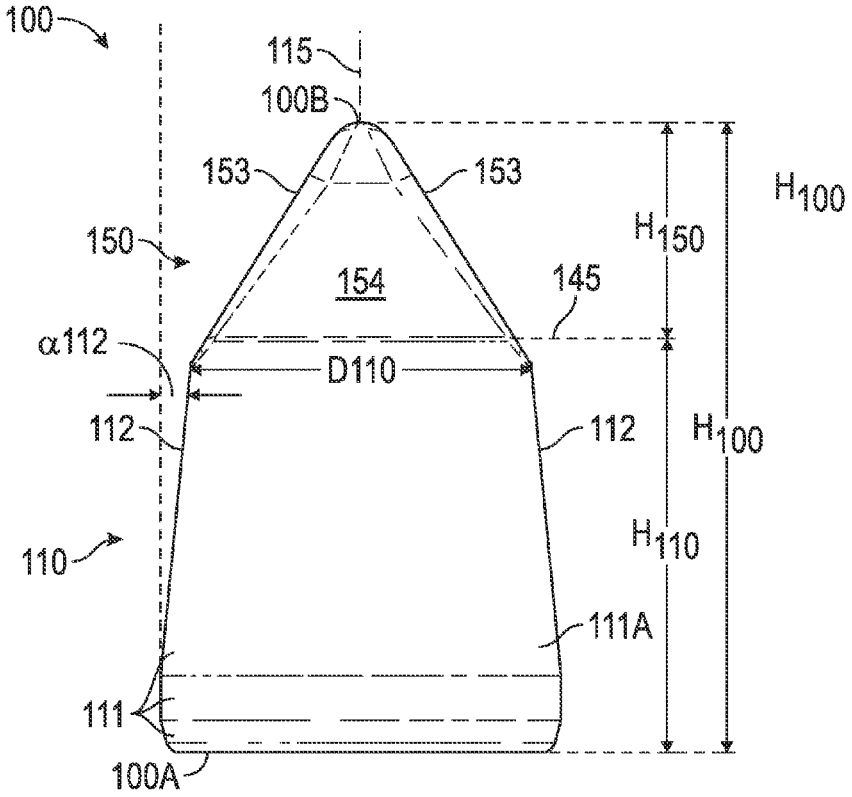
FIG. 4 is a side view of the insert of FIG. 3.
Figure 5:
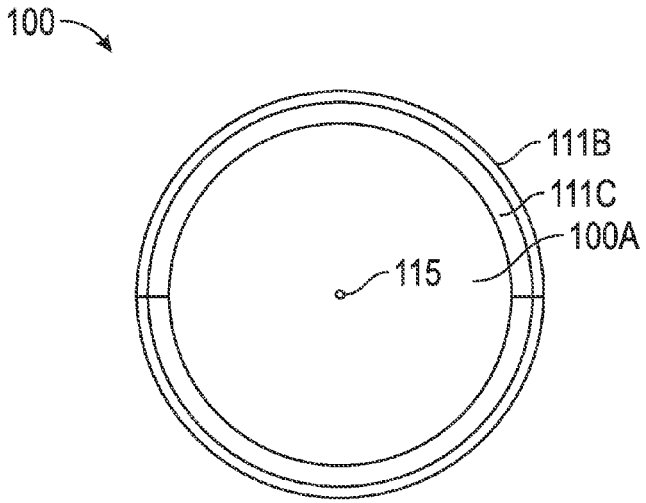
FIG. 5 is a bottom view of the insert of FIG. 3.

Referring now to FIGS. 3-5, one cutting element or insert 100 is shown, and is believed to have particular utility when employed as a bottomhole cutting element, such as in an inner row 60*c* previously described. However, insert 100 can also be employed in other regions of a cone cutter 50, such as in heel row 60*a*, gage row 80, or gage row 81 previously described.

In this embodiment, insert 100 has a first or lower end 100*a*, a second or upper end 100*b*, a base portion 110 extending from lower end 100*a*, and a cutting portion 150 extending from upper end 100*b* to base portion 110. Base portion 110 has a central axis 115 and intersects cutting portion 150 at a reference plane of intersection 145 oriented perpendicular to axis 115. Base portion 110 has a height $H_{110}$ measured axially along axis 115 from lower end 100*b* to cutting portion 150, and cutting portion 150 extends from base portion 110 so as to have an extension height $H_{150}$ measured axially along axis 115 from base portion 110 to upper end 100*b*. Once mounted, the extension height $H_{150}$ of insert 100 is generally the distance from the surface of cone cutter 50 to the outermost point or portion of cutting portion 150 as measured perpendicular to the cone surface and generally parallel to axis 115. Collectively, base portion 110 and cutting portion 150 define the insert's overall height $H_{100}$.

In this embodiment, base portion 110 has a radially outer surface 111 divided into three axially adjacent regions—a first or upper region 111*a* extending axially from cutting portion 150, a second or intermediate region 111*b* extending axially from upper region 111*a* toward lower end 110*b*, and a third or lower region 111*c* extending axially from lower end 110*a* to intermediate region 111*b*. Outer surface 111 is frustoconical in upper region 111*a*, cylindrical in intermediate region 111*b*, and frustoconical in lower region 111*c*. In other words, base portion 110 has an outer diameter $D_{110}$ that (a) increases moving axially along upper region 111*a* from cutting portion 150 to intermediate region 111*b*, (b) is constant moving axially along intermediate region 111*b* from upper region 111*a* to lower region 111*c*, and (c) decreases moving axially along lower region 111*c* from intermediate region 111*b* to lower end 100*a*. In upper region 111*a*, outer surface 111 is oriented at an angle $\alpha_{111a}$ (alpha 111*a*) relative to axis 115. Angle $\alpha_{111a}$ is preferably between 1.0° and 4.0°.

Outer surface 111 also includes a plurality of circumferentially-spaced planar surfaces 112 extending along upper region 111*a* from cutting portion 150 to intermediate region 111*b*. In this embodiment, two planar surfaces 112 angularly spaced 180° apart about axis 115 are provided. Planar surfaces 112 incline or taper towards each other and axis 115 moving axially along region 111*a* from intermediate region 111*b* to cutting portion 150. In particular, each planar surface 112 is oriented at an angle $\alpha_{112}$ relative to axis 115. Angle $\alpha_{112}$ is greater than angle $\alpha_{111a}$ previously described. In particular, angle $\alpha_{112}$ is preferably between 5.0° and 7.0°.

Referring now to FIGS. 3 and 4, in this embodiment, cutting portion 150 has a chisel-shaped cutting surface 151 extending from base portion 110 to an elongate chisel-crest 152 disposed at upper end 100*b* distal base portion 110. In particular, cutting surface 151 includes a pair of planar flanking surfaces 153 and a pair of convex lateral side surfaces 154. Flanking surfaces 153 taper or incline towards one another as they extend from base portion 110 to chisel crest 152, which extends between crest ends or corners 155. In this embodiment, crest ends 155 are partial spheres, each defined by spherical radii. Lateral side surfaces 154 extend from base portion 110 to crest ends 155 and between flanking surfaces 153. Surfaces 153, 154 intersect at rounded edges 156 that extend from base portion 110 to corners 155 and provide a smooth transition between surfaces 153, 154. Each chisel crest 152 extends linearly along a crest median line 157. In this embodiment, inserts 100 are arranged and positioned on cone bodies 51 such that a projection of each crest median line 157 intersects the cone axis 22 of the corresponding cone cutter 50.

Although cutting portion 151 of each bottomhole insert 100 is chisel-shaped in this embodiment, in generally, a cutting portion (e.g., cutting portion 151) having any suitable geometry can be used in connection with a base portion with axial retention features and/or rotational gripping features such as base portion 110. Further, although base portion 110 including axial retention features and rotational gripping features is shown and described in connection with bottomhole inserts 100, a base portion with axial retention features and/or rotational gripping features such as base portion 110 can also be used with any type of insert including, without limitation, heel inserts (e.g., inserts 70) and gage inserts (e.g., gage inserts 80, 81).

Figure 6:
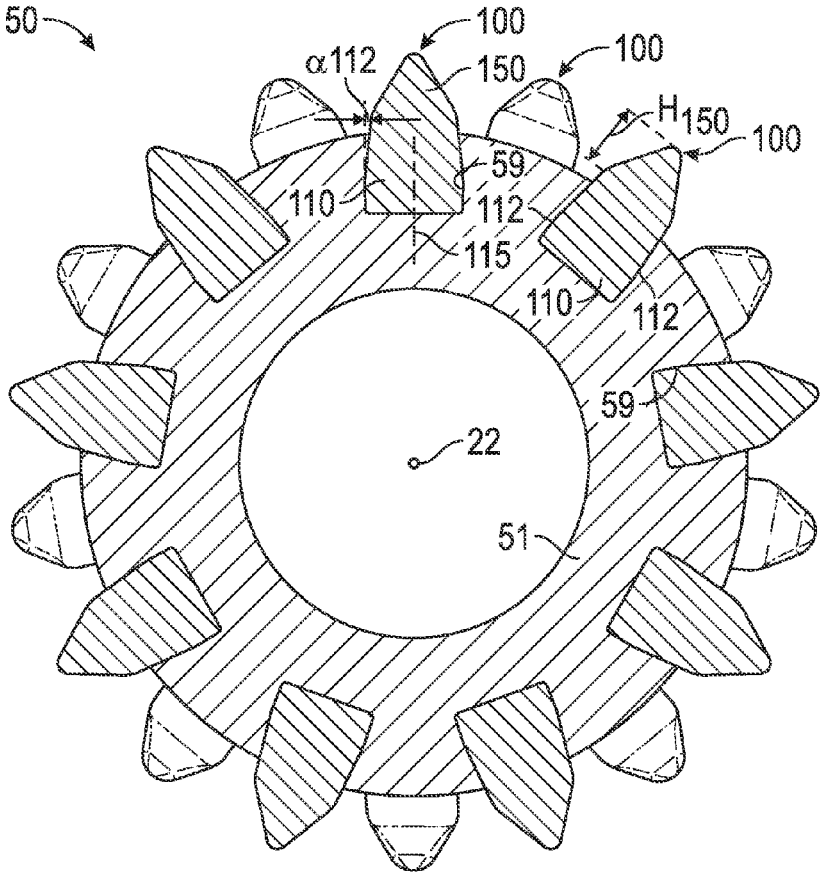
FIG. 6 is a cross-sectional top view of one of the cone cutters of the bit of FIG. 1.

Referring now to FIGS. 3, 4, and 6, inserts 100 are mounted to the corresponding cone body 51 by disposing each base portion 110 in a mating socket or receptacle 59 extending perpendicularly from the outer surface of the cone body 51. Engagement of cone body 51 and base portion 51 restricts insert 100 from moving axially and rotationally (relative to axis 115) relative to cone body 51. However, in this embodiment, retention of insert 100 within cone body 51 and maintenance of insert 100 in a particular rotational orientation relative to cone body 51 is enhanced and augmented by frustoconical outer surface 111 in region 111*a* and tapered planar surfaces 112. In particular, cone body 51 completely surrounds and engages the portion of frustoconical outer surface 111 and tapered planar surfaces 112 disposed in receptacle 59. Engagement of cone body 51 and frustoconical outer surface 111 in region 111*a* prevents insert 100 from moving axially (relative to axis 115) out of the mating socket 59. Similarly, engagement of cone body 51 and tapered planar surfaces 112 prevents insert 100 from moving axially (relative to axis 115) out of the mating socket. Thus, frustoconical outer surface 111 in region 111*a* and tapered planar surfaces 112 prevent insert 100 from popping out of socket 59 and disengaging cone body 51. Accordingly, frustoconical outer surface 111 in region 111*a* and tapered planar surfaces 112 may be described as axial gripping or retention features. Thus, as used herein, the terms "axial gripping feature" and "axial retention feature" refer to non-cylindrical structures, surfaces and features on the base portion of a cutting element or insert that engage the cone body and restrict and/or prevent the cutting element or insert from moving axially out of the socket in the cone body. In addition, engagement of tapered planar surfaces 112 and cone body 51 prevent insert 100 from rotating about axis 115 relative to cone body 51. Thus, tapered planar surfaces 112 maintain the rotational orientation of insert 100 relative to cone body 51. Accordingly, tapered planar surfaces 112 may be described as rotational gripping or torque holding features. Thus, as used herein, the terms "rotational gripping feature" and "torque holding feature" refer to non-cylindrical structures, surfaces and features on the base portion of a cutting element or insert that engage the cone body and restrict and/or prevent the cutting element or insert from rotating about the central axis of the base portion relative to the cone body.

The phenomenon by which formation material is removed by cutting elements during drilling operations is extremely complex. A variety of factors including, without limitation, the geometry and orientation of the cutting elements, the design of the rolling cone cutters, and the type of formation being drilled all play a role in cutting effectiveness, efficiency, and ROP. Depending upon their location in the rolling cone cutter, cutting elements have different cutting trajectories as the cone cutters rotate along the borehole bottom. Cutting elements in certain locations of the cone cutter can have more than one cutting mode. For example, in addition to a scraping or gouging motion, some cutting elements include a twisting motion as move into and out of engagement with the formation. As such, cutting elements are often positioned and rotationally oriented to optimize the cutting and formation removal.

As previously described, conventional inserts typically have a cylindrical base portion secured within a cylindrical bore in the cone cutter by an interference fit. During drilling operations, such inserts may loosen, potentially resulting in rotation of the insert within the bore relative to the cone body and/or axial movement of the insert relative to the cone body. Rotation of an insert may result in a less than optimal orientation of the insert, and sufficient axial movement of the insert may result in complete loss of the insert (i.e., the insert may pop out of the bore). However, in embodiments described herein, the base portion of the insert includes non-cylindrical axial retention features and/or non-cylindrical rotational gripping feature that prevent rotation and axial movement of the insert, respectively, relative to the cone body.

The materials used to form the cutting elements described herein (e.g., cutting elements 70, 80, 81, 100) can be tailored to optimize performance while withstanding the loads experienced by particular portion(s) of the cutting element. For example, it is known that as a rolling cone cutter rotates within the borehole, certain cutting elements (e.g., bottom-hole cutting elements) impact and penetrate the formation. Accordingly, such cutting elements are preferably made of impact resistant, high toughness materials. Whereas other cutting elements (e.g., heel cutting elements) scrape and slide across the formation. Accordingly, such cutting elements are preferably made of, or have a coatings comprising, a high wear resistant material. Examples of suitable materials for cutting elements described herein include, without limitation, metals such as tungsten carbide. Suitable surface coatings for cutting elements described herein include, without limitation, differing grades of hard abrasives, such as tungsten carbide and polycrystalline diamond (PCD). In many instances, improvements in wear resistance, bit life and durability may be achieved where only certain cutting portions of the cutting elements include the hard abrasive coating.

In general, embodiments of inserts described herein (e.g., inserts 70, 80, 81, 100) can be made in any conventional manner such as hot isostatic pressing (HIP). In general, HIP is a known manufacturing techniques that employs high pressure and high temperature to consolidate metal, ceramic, or composite powder to fabricate components in desired shapes. In addition to HIP techniques, inserts described herein can be made using other conventional manufacturing processes, such as hot pressing, rapid omnidirectional compaction, vacuum sintering, or sinter-HIP.

Figure 7:
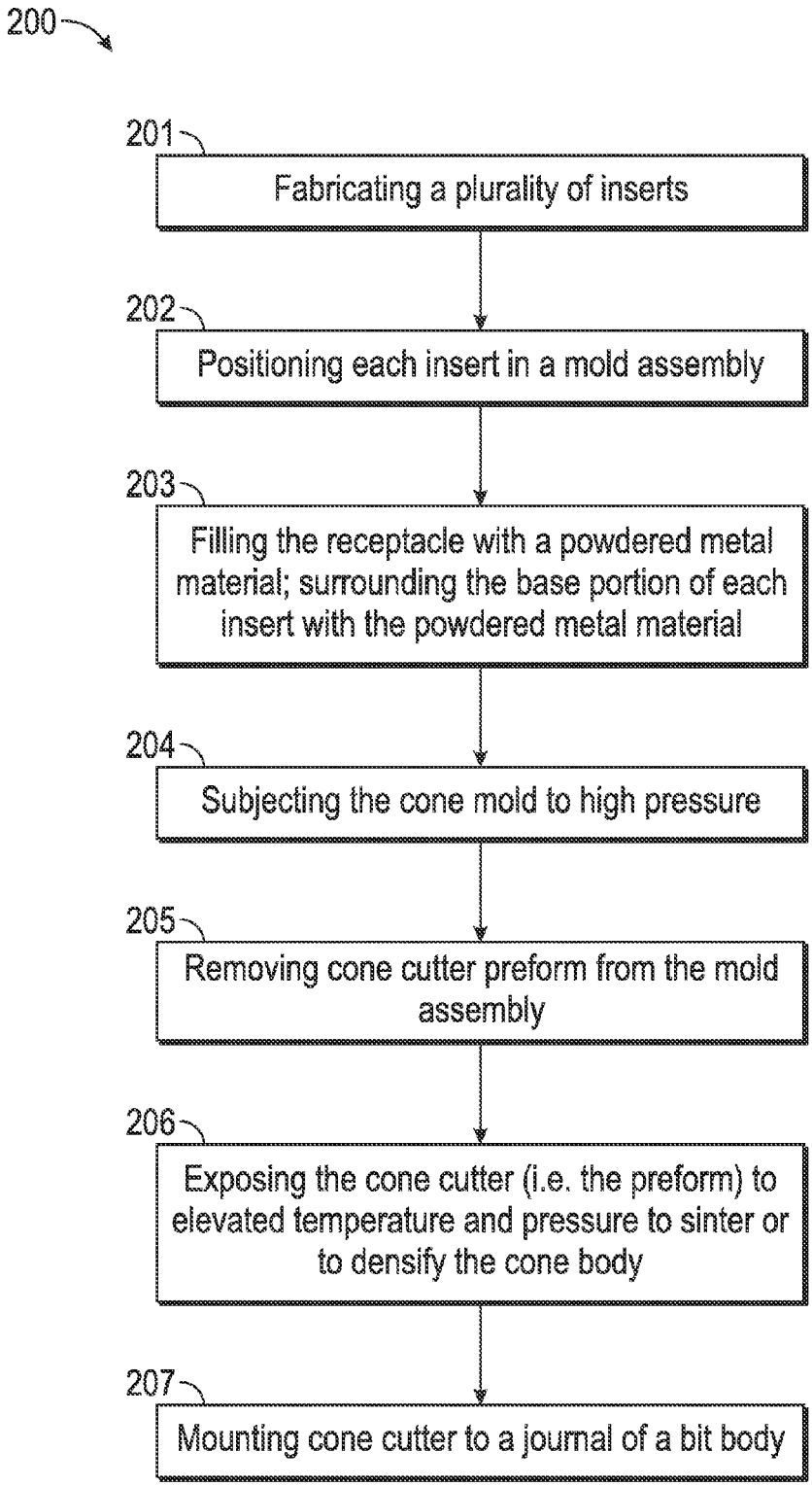
FIG. 7 is a graphical illustration of an embodiment of a method for manufacturing one of the cone cutters of FIG. 1 in accordance with principles disclosed herein.
Figure 8:
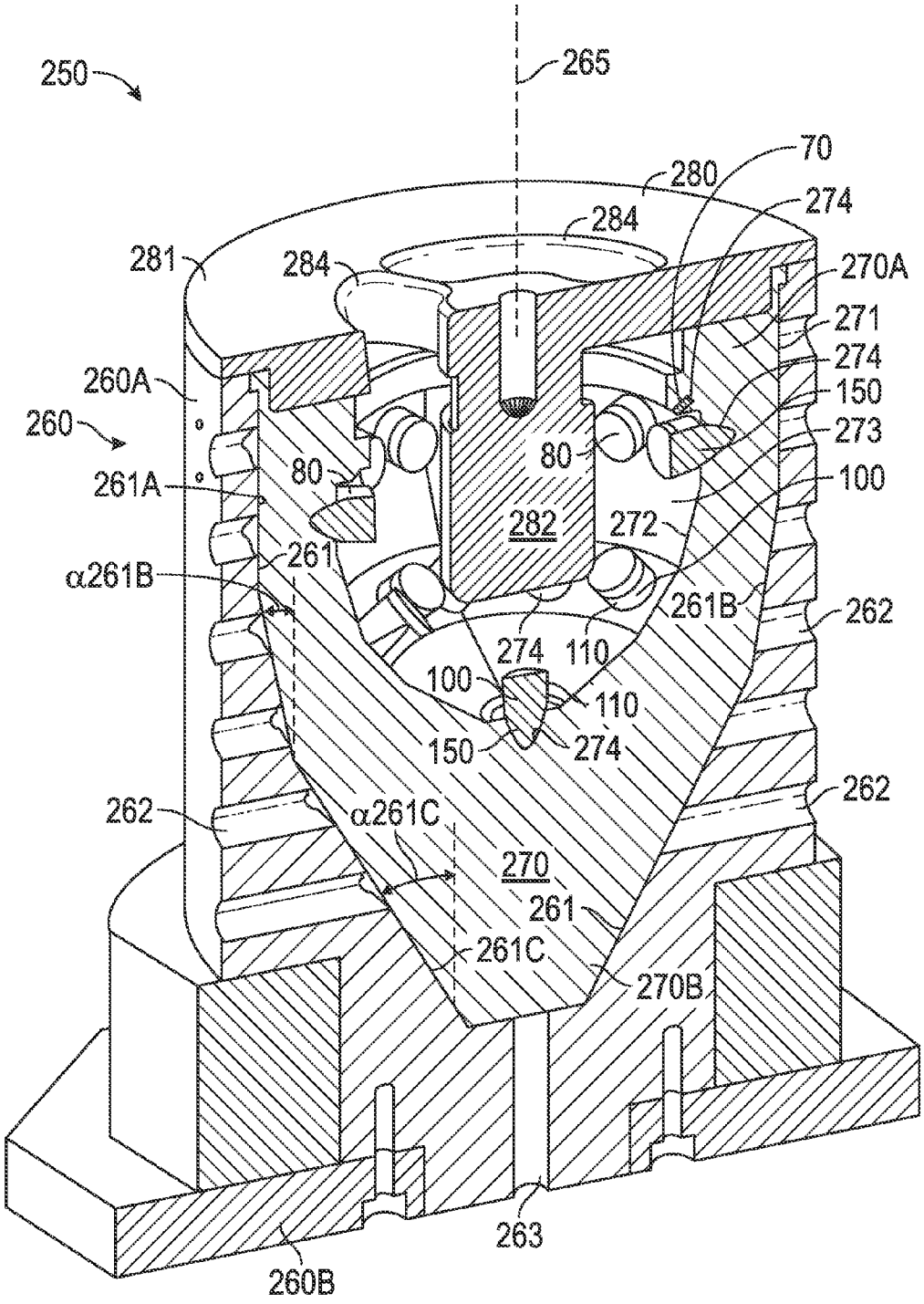
FIG. 8 is a cross-sectional perspective side view of a mold for forming one of the cone cutters of FIG. 1 using the method of FIG. 7.

FIG. 7 illustrates a method 200 for forming drill bit 10 using a cone mold assembly 250 shown in FIG. 8. For purposes of clarity, mold assembly 250 will first be described, followed by method 200.

Referring now to FIG. 8, cone mold assembly 250 includes a generally cylindrical housing or canister 260, a conical compliant mold "bag" 270 disposed in canister 260, a mold ring 280 coupled to canister 260 and securing bag 270 therein, and a sealing cap (not shown). Canister 260 has a central axis 265, a first or upper end 260*a*, a second or lower end 260*b*, a receptacle 261 extending axially from end 260*a* toward lower end 260*b*, a plurality of throughbores 262 extending radially from the outer surface of canister 260 to receptacle 261, and a throughbore 263 extending axially from lower end 260*b* to receptacle 261. In this embodiment, the diameter of receptacle 261 generally decreases moving from upper end 260*a*. In particular, receptacle 261 has a cylindrical upper portion or section 261*a*, a tapered or frustoconical intermediate portion or section 261*b*, and a tapered or frustoconical lower portion or section 261*c*. The inner surface of canister 260 defining receptacle 261 is parallel to axis 265 in upper section 261*a*, oriented at an angle $\alpha_{261b}$ relative to axis 265 in intermediate section 261*b*, and oriented at an angle $\alpha_{261c}$ in lower section 261*c*. Angle $\alpha_{261b}$ is less than angle $\alpha_{261c}$.

Referring still to FIG. 8, mold bag 270 is coaxially seated in receptacle 261 and is formed from a compliant, resilient material such as rubber, silicon, or polyurethane. Bag 270 has a first or upper end 270*a*, a second or lower end 270*b*, an outer surface 271 that generally mates and conforms to receptacle 261 of canister 260, and an inner surface 272 defined by a receptacle 273 extending axially from upper end 270*a*. Receptacle 273 is a negative of one cone cutter 50. Consequently, inner surface 272 includes a plurality of surfaces and features that generally correspond to the surfaces and features of one cone cutter 50 to be formed with assembly 200. For example, inner surface 272 includes a plurality of recesses or pockets 274 that define the locations of inserts 70, 80, 81, 100 and hold inserts 70, 80, 81, 100 in position during formation of cone cutter 50. Each recess 274 has a shape that is a negative of the cutting portion of the corresponding insert 70, 80, 81, 100 disposed therein. It should be appreciated that the number, type, and placement of inserts 70, 80, 81, 100 in each cone cutter 50 may vary somewhat. Accordingly, a different bag mold 270 with appropriately positioned recesses 274 is employed for each cone cutter 50.

Mold ring 280 is removably secured to upper end 260*a* of canister 260 and includes a annular plate 281 and a generally cylindrical mandrel 282 extending coaxially from plate 281 into receptacle 273. Plate 281 includes a plurality of circumferentially-spaced apertures 284 disposed about mandrel 282 and extending axially through plate 281. With mold assembly 250 fully assembled as shown in FIG. 8, mold ring 280 is secured to upper end 260*a* and axially abuts upper end 270*a* of bag mold 270, thereby maintaining bag mold 270 within canister 260.

Referring now to FIG. 7, in method 200, inserts 70, 80, 81, 100 are prefabricated/preformed using conventional techniques previously described (e.g., HIP) in block 201, and then positioned in a cone mold assembly 250 in block 202. In particular, inserts 70, 80, 81, 100 are seated in corresponding recesses 274 with the cutting portions of inserts 70, 80, 81, 100 (i.e., the portion of inserts 70, 80, 81, 100 that extend from cone body 51 and engage the formation during drilling) engaging mold bag 270, and the base portions of inserts 70, 80, 81, 100 (i.e., the portion of inserts 70, 80, 81, 100 seated in cone body 51) extending into receptacle 273.

Moving now to block 203, with inserts 70, 80, 81, 100 seated in recesses 274, mold bag 270 is filled with a powdered metal, such as 4815 steel or other type of steel powder, which completely surrounds the portions of inserts 70, 80, 81, 100 extending into receptacle 273. Prior to filling mold bag with the powdered metal, an adhesive comprising a powdered metal such as tungsten carbide can be sprayed on inner surface 272 to form a hard coating on the exterior surface of the cone body 51. Mold ring 280 may be temporarily separated from the remainder of mold assembly 250 during a portion of the filling process, for example, while spraying the adhesive on the inside of bag mold 270. However, mold ring 280 is preferably secured to canister 260 prior to filling bag mold 270 with the powdered metal. A sealing cap (not shown) is placed on mold ring 280 to cover and seal the apertures 284.

Referring still to FIG. 7, in block 204, mold assembly 200 and its contents are subjected to high pressure using, for example, a cold isostatic pressing (CIP) process, as known in the art. During CIP, mold assembly 200 is placed in a pressure vessel, which is filled with water and pressurized. The water exerts pressure (e.g., 40,000 psi or more) directly on compliant bag 270 via bores 262, 263 in canister 260 and indirectly on the powdered metal in bag 270. In block 204, the powdered metal is compressed and densified (i.e. achieves a greater density than it had prior to block 204) and forms a rigid, intermediate structure of cone cutter 50, sometimes referred to as a cone cutter "preform." The cone body of the cone cutter preform may have a density of about 80% of the final density of the finished cone body 51. Next, in block 205, the cone cutter preform is removed from canister 260 and mold bag 270, and then in block 206, the partially-densified cone cutter (i.e. the preform) is exposed to an elevated temperature and pressure in order to sinter and/or densify further the cone body 51. In particular, the cone cutter preform is pre-heated and placed in a vessel which is next filled with a pressure transfer medium, such as pulverized or granular graphite that is also preheated. In some instances, the preheat temperatures are about 1040 C (or approximately 1900 F). The cone cutter preform and the graphite are subjected to very high pressures (e.g., about 3.2 million psi) using a mechanical press to further densify and sinter the cone body 51. It should be appreciated that the formed cone body 51 completely surrounds and engages the base portion of each insert 70, 80, 81, 100. Thus, any axial retention features and torque holding features provided on the base portions of inserts 70, 80, 81, 100 (e.g., frustoconical outer surface 111 in region 111*a* and tapered planar surfaces 112) are engaged and gripped by cone body 51. The process of forming cone body 51 using a powdered metal described above is generally known in the art as a Powder Forged Cutter (PFC) manufacturing process, which may also be called the Powder Metal Cutter (PMC) process, and incorporates a densification method commonly known as the Ceracon® process.

Referring still to FIG. 7, following the formation of cone cutter 50 with inserts 70, 80, 81, 100 securely mounted thereto, cone body 51 may be machined, as necessary, to ensure appropriate tolerances. Each cone cutter 50 is manufactured in the same manner. After all three cone cutters 50 are formed, they are mounted to journals 20 of bit body 12 in block, 206 to form the bit 10 shown in FIG. 1.

In the manner described, bit 10 including cone cutters 50 with inserts 70, 80, 81, 100 securely mounted thereto is formed. As previously described, base portion 110 of bottomhole inserts 100 include axial gripping features (i.e., frustoconical outer surface 111 in region 111*a* and tapered planar surfaces 112) and torque holding features (i.e., tapered planar surfaces 112) that are engaged by cone body 51 and prevent inserts 100 from moving axially out of mating sockets 59 in cone body 51 and prevent inserts 100 from rotating about axes 115 relative to cone body 51. Although the axial gripping features and torque holding features have been described in connection with base portions 110 of bottomhole inserts 100, axial gripping features and torque holding features such as frustoconical outer surface 111 in region 111*a* and tapered planar surfaces 112 previously described can also be provided on the base portions of any one or more of inserts 70, 80, 81 to prevent them from moving axially out of mating sockets in cone body 51 and prevent them from rotating relative to cone body 51.

Figure 9:
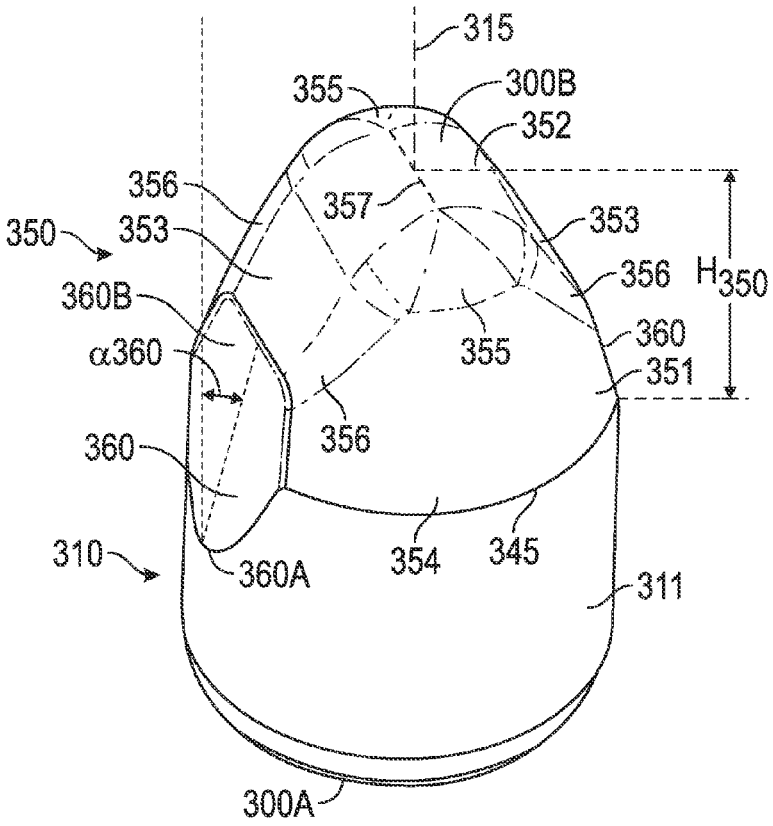
FIG. 9 is a perspective view of an embodiment of an insert for use in a rolling cone bit in accordance with the principles described herein.
Figure 10:
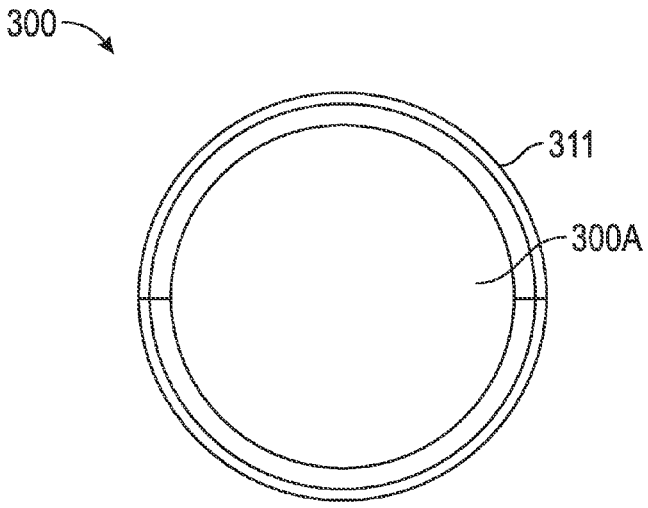
FIG. 10 is a bottom view of the insert of FIG. 9.

Referring now to FIGS. 9 and 10, an embodiment of an insert 300 for a rolling cone bit is shown. In general, insert 300 can be mounted at any suitable location on a rolling cone cutter of a rolling cone bit in the same manner as insert 100 previously described. Although insert 300 is believed to have particular utility as a bottomhole cutting element, it may also be employed as a heel cutting element or gage cutting element.

Insert 300 has a first or lower end 300*a*, a second or upper end 300*b*, a base portion 310 extending from lower end 300*a*, and a cutting portion 350 extending from upper end 300*b* to base portion 310. Base portion 310 has a central axis 315 and intersects cutting portion 350 at a reference plane of intersection 345 oriented perpendicular to axis 315. Cutting portion 350 extends from base portion 310 so as to define an extension height $H_{350}$ measured axially along axis 315 from base portion 310 to upper end 300*b*. Once mounted in a body of a cone cutter (e.g., body 51), the extension height $H_{350}$ of insert 300 is generally the distance from the surface of the cone cutter to the outermost point or portion of cutting portion 350 as measured perpendicular to the cone surface and generally parallel to axis 315.

Unlike base portion 110 of insert 100 previously described, in this embodiment, base portion 310 is cylindrical, having a cylindrical outer surface 311 extending axially from plane 345 to tapered lower end 300*a*. In other embodiments, the base portion (e.g., base portion 310) can be frustoconical instead of cylindrical. In this embodiment, cutting portion 350 has a chisel-shaped cutting surface 351 extending from base portion 310 to an elongate chisel-crest 352 disposed at upper end 300*b* distal base portion 310. In particular, cutting surface 351 includes a pair of planar flanking surfaces 353 and a pair of convex lateral side surfaces 354. Flanking surfaces 353 taper or incline towards one another as they extend to chisel crest 352, which extends between crest ends or corners 355. In this embodiment, crest ends 355 are partial spheres. Lateral side surfaces 354 extend from base portion 310 to crest ends 355 and between flanking surfaces 353. Surfaces 353, 354 intersect at rounded edges 356 that extend to corners 355 and provide a smooth transition between surfaces 353, 354. Chisel crest 352 extends linearly along a crest median line 357. Insert 300 is preferably mounted on a cone body such that a projection of crest median line 357 intersects the cone axis of rotation or is parallel the cone axis of rotation.

Referring still to FIGS. 9 and 10, the outer surface of insert 300 includes a plurality of circumferentially-spaced planar surfaces 360 extending along base portion 310 across plane 345 into cutting portion 350. In this embodiment, two planar surfaces 360 angularly spaced 180° apart about axis 315 are provided. Each planar surface 360 has a first or lower end 360*a* intersection cylindrical surface 311 of base portion 310 and a second or upper end 360*b* intersecting flanking surfaces 353 and rounded edges 356. Thus, planar surfaces 360 extend across plane 345 and a portion of surfaces 311, 353.

Planar surfaces 360 incline or taper towards each other and axis 315 moving axially from lower ends 360*a* to upper ends 360*b*. Each planar surface 360 is preferably oriented at an angle $\alpha_{360}$ relative to axis 315 between 3.0° and 7.0°. With insert 300 mounted to a cone body (e.g., cone body 51) with base portion 310 seated in a mating socket in the cone body and surrounded by the cone body, engagement of cone body and tapered surfaces 360 prevents insert 300 from moving axially (relative to axis 315) out of the mating socket, and thus, functions as an axial retention feature. In addition, engagement of tapered surfaces 360 and the cone body prevent insert 300 from rotating about axis 315 relative to the cone body, and thus, also function as torque holding features.

Figure 11:
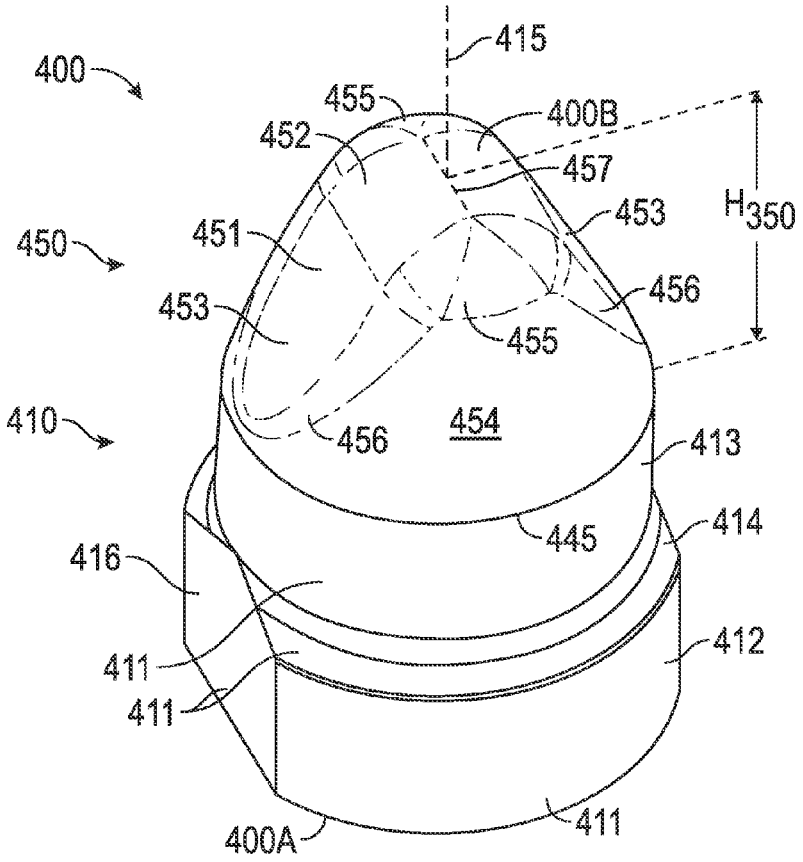
FIG. 11 is a perspective view of an embodiment of an insert for use in a rolling cone bit in accordance with the principles described herein.
Figure 12:
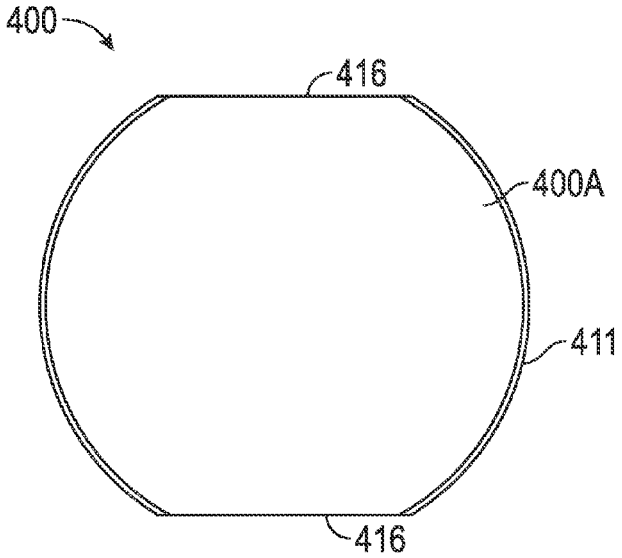
FIG. 12 is a bottom view of the insert of FIG. 11.

Referring now to FIGS. 11 and 12, an embodiment of an insert 400 for a rolling cone bit is shown. In general, insert 400 can be mounted at any suitable location on a rolling cone cutter of a rolling cone bit in the same manner as insert 100 previously described. Although insert 400 is believed to have particular utility as a bottomhole cutting element, it may also be employed as a heel cutting element or gage cutting element.

Insert 400 has a first or lower end 400*a*, a second or upper end 400*b*, a base portion 410 extending from lower end 400*a*, and a cutting portion 450 extending from upper end 400*b* to base portion 410. Base portion 410 has a central axis 415 and intersects cutting portion 450 at a reference plane of intersection 445 oriented perpendicular to axis 415. Cutting portion 450 extends from base portion 410 so as to define an extension height $H_{450}$ measured axially along axis 415 from base portion 410 to upper end 400*b*. Once mounted in a body of a cone cutter (e.g., body 51), the extension height $H_{450}$ of insert 400 is generally the distance from the surface of the cone cutter to the outermost point or portion of cutting portion 450 as measured perpendicular to the cone surface and generally parallel to axis 415.

Base portion 410 has an outer surface 411 extending from lower end 400*a* to plane 445. In this embodiment, outer surface 411 includes a cylindrical portion or surface 412 extending axially from lower end 400*a*, a cylindrical portion or surface 413 extending axially from reference plane 445, and an annular shoulder 414 extending generally radially between surfaces 412, 413. Cylindrical surface 412 is disposed at a diameter that is greater than the diameter of cylindrical surface 413, and thus, shoulder 414 is upward-facing (i.e., faces towards end 400*b*). In addition, in this embodiment, outer surface 411 includes a plurality of circumferentially-spaced planar surfaces 416 extending parallel to axis 415 from lower end 400*a* to shoulder 414. Thus, surfaces 416 bisect or cut across cylindrical surface 412. In this embodiment, two parallel planar surfaces 416 angularly spaced 180° apart about axis 415 are provided. Each planar surface 416 is disposed at a radially distance measured perpendicularly from axis 415 equal to the radius of cylindrical surface 413.

Referring still to FIGS. 11 and 12, in this embodiment, cutting portion 450 has a chisel-shaped cutting surface 451 extending from base portion 410 to an elongate chisel-crest 452 disposed at upper end 400*b* distal base portion 410. In particular, cutting surface 451 includes a pair of planar flanking surfaces 453 and a pair of convex lateral side surfaces 454. Flanking surfaces 453 taper or incline towards one another as they extend from proximal base portion 410 to chisel crest 452, which extends between crest ends or corners 455. In this embodiment, crest ends 455 are partial spheres, each defined by spherical radii. Lateral side surfaces 454 extend from base portion 410 to crest ends 455 and between flanking surfaces 453. Surfaces 453, 454 intersect at rounded edges 456 that extend from proximal base portion 410 to corners 455 and provide a smooth transition between surfaces 453, 454. Chisel crest 452 extends linearly along a crest median line 457. Insert 400 is preferably mounted on a cone body such that a projection of crest median line 457 intersects the cone axis of rotation.

With insert 400 mounted to a cone body (e.g., cone body 51) with base portion 410 seated in a mating socket in the cone body and surrounded by the cone body, engagement of cone body and annular shoulder 414 prevents insert 400 from moving axially (relative to axis 415) out of the mating socket, and thus, functions as an axial retention feature. In addition, engagement of planar surfaces 416 and the cone body prevent insert 400 from rotating about axis 415 relative to the cone body, and thus, function as torque holding features.

Figure 13:
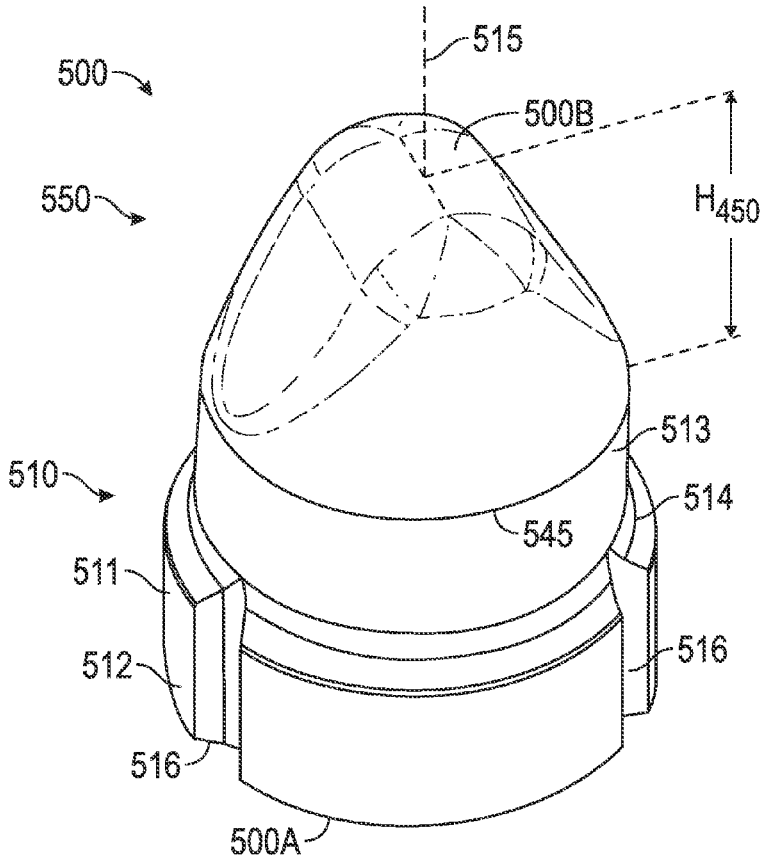
FIG. 13 is a perspective view of an embodiment of an insert for use in a rolling cone bit in accordance with the principles described herein.
Figure 14:
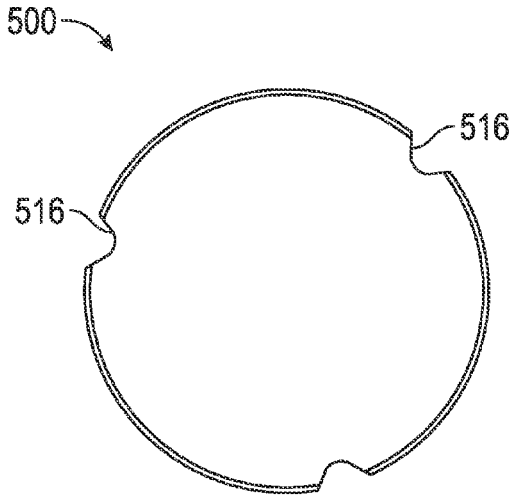
FIG. 14 is a bottom view of the insert of FIG. 13.

Referring now to FIGS. 13 and 14, an embodiment of an insert 500 for a rolling cone bit is shown. In general, insert 500 can be mounted at any suitable location on a rolling cone cutter of a rolling cone bit in the same manner as insert 100 previously described. Although insert 500 is believed to have particular utility as a bottomhole cutting element, it may also be employed as a heel cutting element or gage cutting element.

Insert 500 has a first or lower end 500*a*, a second or upper end 500*b*, a base portion 510 extending from lower end 500*a*, and a cutting portion 450 as previously described extending from upper end 500*b* to base portion 510. Cutting portion 450 extends from base portion 510 so as to define an extension height $H_{450}$ measured axially along axis 515 from base portion 510 to upper end 500*b*. Once mounted in a body of a cone cutter (e.g., body 51), the extension height $H_{450}$ of insert 500 is generally the distance from the surface of the cone cutter to the outermost point or portion of cutting portion 450 as measured perpendicular to the cone surface and generally parallel to axis 515.

Base portion 510 has a central axis 515 and intersects cutting portion 450 at a reference plane of intersection 545 oriented perpendicular to axis 515. In addition, base portion 510 has an outer surface 511 extending from lower end 500*a* to plane 545. Similar to insert 400 previously described, in this embodiment, outer surface 511 includes a cylindrical portion or surface 512 extending axially from lower end 500*a*, a cylindrical portion or surface 513 extending axially from reference plane 545, and an annular shoulder 514 extending generally radially between surfaces 512, 513. Cylindrical surface 512 is disposed at a diameter that is greater than the diameter of cylindrical surface 513, and thus, shoulder 514 is upward-facing (i.e., faces towards end 500*b*). However, unlike insert 400 previously described, in this embodiment, outer surface 511 does not include circumferentially-spaced planar surfaces 416. Rather, in this embodiment, outer surface 511 includes a plurality of circumferentially-spaced elongate notches or recesses 516 extending axially from lower end 500*a* to shoulder 514. Thus, surfaces 516 cut into cylindrical surface 512. In this embodiment, three parallel notches 516 uniformly angularly spaced 120° apart about axis 515 are provided. Each notch 516 is oriented parallel to axis 515 and has a radial depth equal to the difference between the radii of surfaces 512, 513.

With insert 500 mounted to a cone body (e.g., cone body 51) with base portion 510 seated in a mating socket in the cone body and surrounded by the cone body, engagement of cone body and annular shoulder 514 prevents insert 500 from moving axially (relative to axis 515) out of the mating socket, and thus, functions as an axial retention feature. In addition, engagement of notches 516 and the cone body prevent insert 500 from rotating about axis 515 relative to the cone body, and thus, function as torque holding features.

Figure 15:
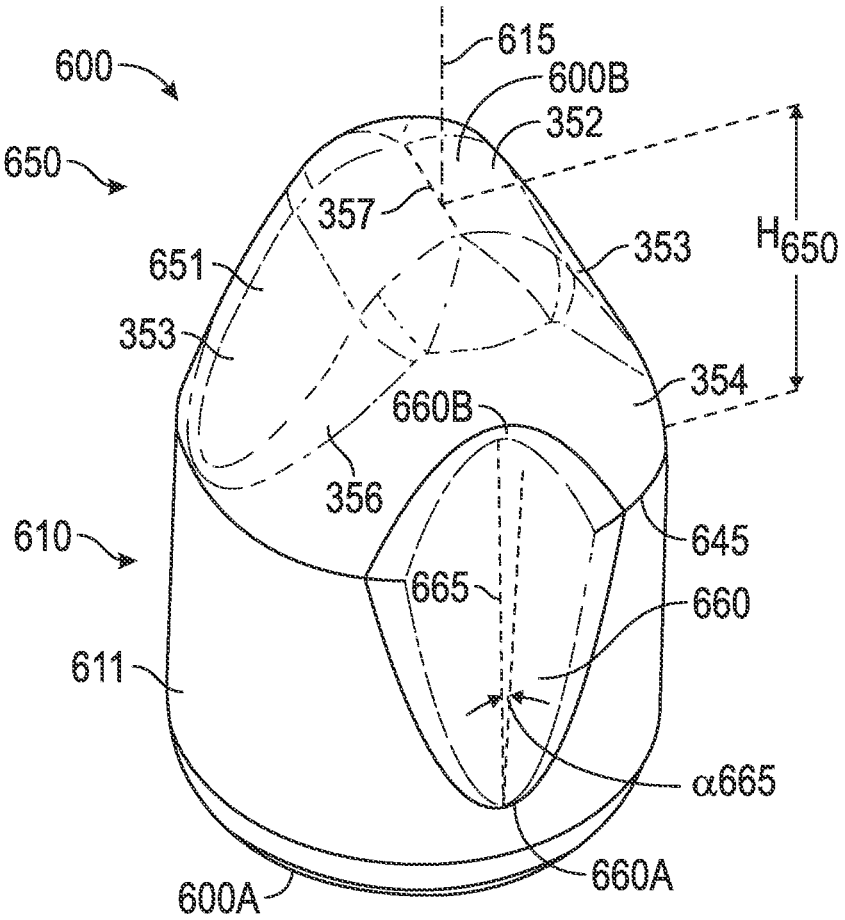
FIG. 15 is a perspective view of an embodiment of an insert for use in a rolling cone bit in accordance with the principles described herein.

Referring now to FIG. 15, an embodiment of an insert 600 for a rolling cone bit is shown. In general, insert 600 can be mounted at any suitable location on a rolling cone cutter of a rolling cone bit in the same manner as insert 100 previously described. Although insert 600 is believed to have particular utility as a bottomhole cutting element, it may also be employed as a heel cutting element or gage cutting element.

Insert 600 has a first or lower end 600*a*, a second or upper end 600*b*, a base portion 610 extending from lower end 600*a*, and a cutting portion 650 extending from upper end 600*b* to base portion 610. Base portion 610 has a central axis 615 and intersects cutting portion 650 at a reference plane of intersection 645 oriented perpendicular to axis 615. Cutting portion 650 extends from base portion 610 so as to define an extension height $H_{650}$ measured axially along axis 615 from base portion 610 to upper end 600*b*. Once mounted in a body of a cone cutter (e.g., body 51), the extension height $H_{650}$ of insert 600 is generally the distance from the surface of the cone cutter to the outermost point or portion of cutting portion 650 as measured perpendicular to the cone surface and generally parallel to axis 615.

In this embodiment, base portion 610 is cylindrical, having a cylindrical outer surface 611 extending axially from plane 645 to lower end 600*a*. In this embodiment, cutting portion 650 has a chisel-shaped cutting surface 651 extending from base portion 610 to upper end 600*b* distal base portion 610. Cutting surface 651 is similar to cutting surface 351 previously described. Namely, cutting surface 651 includes a pair of planar flanking surfaces 353 that taper or incline towards one another as they extend to a chisel crest 352 and a pair of convex lateral side surfaces 354, each as previously described. Surfaces 353, 354 intersect at rounded edges 356 as previously described. Insert 600 is preferably mounted on a cone body such that a projection of crest median line 357 intersects the cone axis of rotation.

Referring still to FIG. 15, the outer surface of insert 600 includes a plurality of circumferentially-spaced concave recesses 660 extending along base portion 610 across plane 645 into cutting portion 650. In this embodiment, two recesses 660 angularly spaced 180° apart about axis 615 are provided. Each concave recess 660 extends along a centerline 665 between a first or lower end 660*a* intersecting cylindrical surface 611 of base portion 610 and a second or upper end 660*b* intersecting lateral side surfaces 354. Thus, concave recesses 660 extend across plane 645 and a portion of surfaces 311, 354.

Concave recesses 660 incline or taper towards each other and axis 615 moving axially from lower ends 660*a* to upper ends 660*b*. In particular, each centerline 665 is preferably oriented at an angle $\alpha_{665}$ relative to axis 615 between 3.0° and 7.0°. With insert 600 mounted to a cone body (e.g., cone body 51) with base portion 610 seated in a mating socket in the cone body and surrounded by the cone body, engagement of cone body and tapered recesses 660 prevents insert 600 from moving axially (relative to axis 615) out of the mating socket, and thus, functions as an axial retention feature. In addition, engagement of recesses 660 and the cone body prevent insert 600 from rotating about axis 615 relative to the cone body, and thus, also function as torque holding features.

Figure 16:
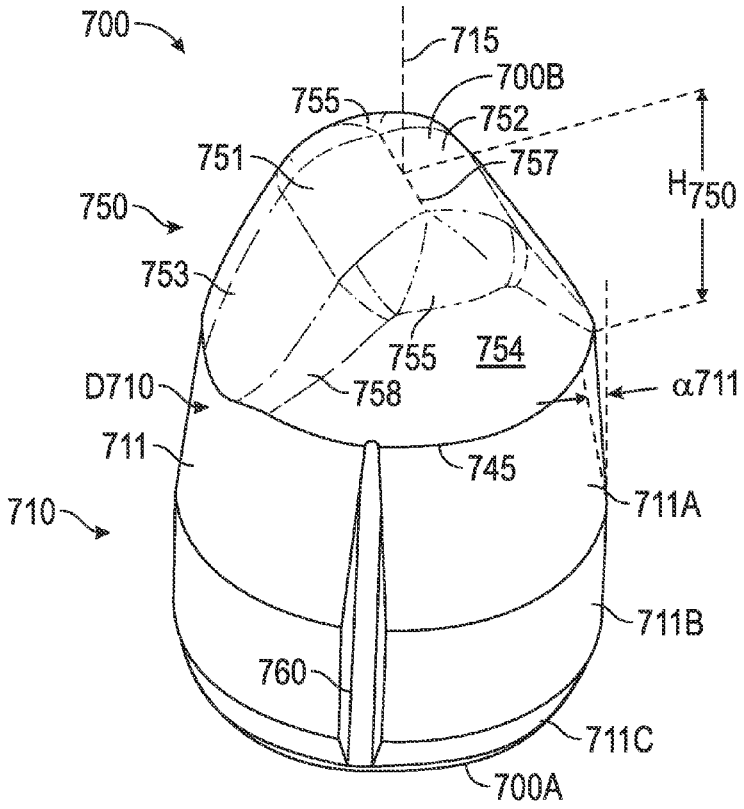
FIG. 16 is a perspective view of an embodiment of an insert for use in a rolling cone bit in accordance with the principles described herein.
Figure 17:
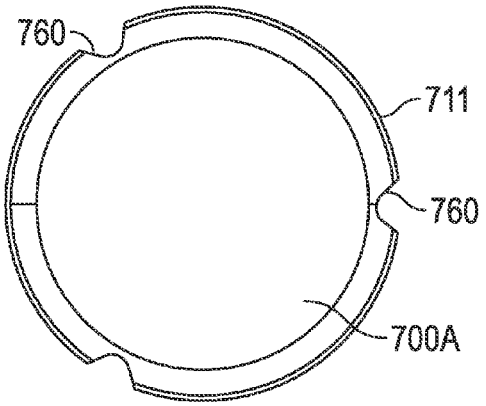
FIG. 17 is a bottom view of the insert of FIG. 16.

Referring now to FIGS. 16 and 17, an embodiment of an insert 700 for a rolling cone bit is shown. In general, insert 700 can be mounted at any suitable location on a rolling cone cutter of a rolling cone bit in the same manner as insert 100 previously described. Although insert 700 is believed to have particular utility as a bottomhole cutting element, it may also be employed as a heel cutting element or gage cutting element.

Insert 700 has a first or lower end 700*a*, a second or upper end 700*b*, a base portion 710 extending from lower end 700*a*, and a cutting portion 750 extending from upper end 700*b* to base portion 710. Base portion 710 has a central axis 715 and intersects cutting portion 750 at a reference plane of intersection 745 oriented perpendicular to axis 715. Cutting portion 750 extends from base portion 710 so as to define an extension height $H_{750}$ measured axially along axis 715 from base portion 710 to upper end 700*b*. Once mounted in a body of a cone cutter (e.g., body 51), the extension height $H_{750}$ of insert 700 is generally the distance from the surface of the cone cutter to the outermost point or portion of cutting portion 750 as measured perpendicular to the cone surface and generally parallel to axis 715.

In this embodiment, base portion 710 is similar to base portion 110 previously described. Namely, base portion 710 has a radially outer surface 711 divided into three axially adjacent regions—a first or upper region 711*a* extending axially from cutting portion 750, a second or intermediate region 711*b* extending axially from upper region 711*a* toward lower end 700*b*, and a third or lower region 711*c* extending axially from lower end 700*a* to intermediate region 711*b*. Outer surface 711 is frustoconical in upper region 711*a*, cylindrical in intermediate region 711*b*, and frustoconical in lower region 711*c*. In other words, base portion 710 has an outer diameter D710 that (a) increases moving axially along upper region 711*a* from cutting portion 750 to intermediate region 711*c*, (b) is constant moving axially along intermediate region 711*b* from upper region 711*a* to lower region 711*c*, and (c) decreases moving axially along lower region 711*c* from intermediate region 711*b* to lower end 700*a*. In upper region 711*a*, outer surface 711 is preferably oriented at an angle $\alpha$711*a* relative to axis 715 between 2.0° and 5.0°.

Outer surface 711 also includes a plurality of circumferentially-spaced elongate notches or recesses 760 extending axially from lower end 700*a* to cutting portion 750. Thus, recesses 760 cut across outer surface 711. In this embodiment, three parallel notches 760 uniformly angularly spaced 120° apart about axis 715 are provided. Each notch 760 is oriented parallel to axis 715.

Referring still to FIGS. 16 and 17, in this embodiment, cutting portion 750 has a chisel-shaped cutting surface 751 extending from base portion 710 to an elongate chisel-crest 752 disposed at upper end 700*b* distal base portion 710. In particular, cutting surface 751 includes a pair of planar flanking surfaces 753 and a pair of convex lateral side surfaces 754. Flanking surfaces 753 taper or incline towards one another as they extend from base portion 710 to chisel crest 752, which extends between crest ends or corners 755. In this embodiment, crest ends 755 are partial spheres, each defined by spherical radii. Lateral side surfaces 754 extend from base portion 710 to crest ends 755 and between flanking surfaces 753. Surfaces 753, 754 intersect at rounded edges 756 that extend from base portion 710 to corners 755 and provide a smooth transition between surfaces 753, 754. Chisel crest 752 extends linearly along a crest median line 757. Insert 700 is preferably mounted on a cone body such that a projection of crest median line 757 intersects the cone axis of rotation.

With insert 700 mounted to a cone body (e.g., cone body 51) with base portion 710 seated in a mating socket in the cone body and surrounded by the cone body, engagement of cone body and frustoconical portion of outer surface 711 in region 711*a* prevents insert 700 from moving axially (relative to axis 715) out of the mating socket, and thus, functions as an axial retention feature. In addition, engagement of notches 760 and the cone body prevent insert 700 from rotating about axis 715 relative to the cone body, and thus, function as torque holding features.

Figure 18:
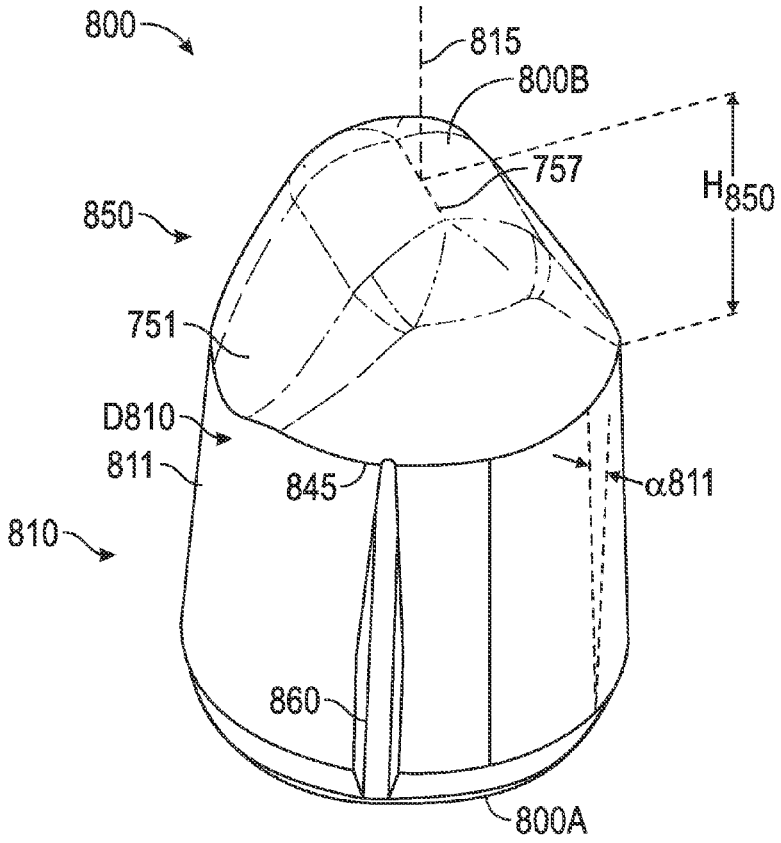
FIG. 18 is a perspective view of an embodiment of an insert for use in a rolling cone bit in accordance with the principles described herein.
Figure 19:
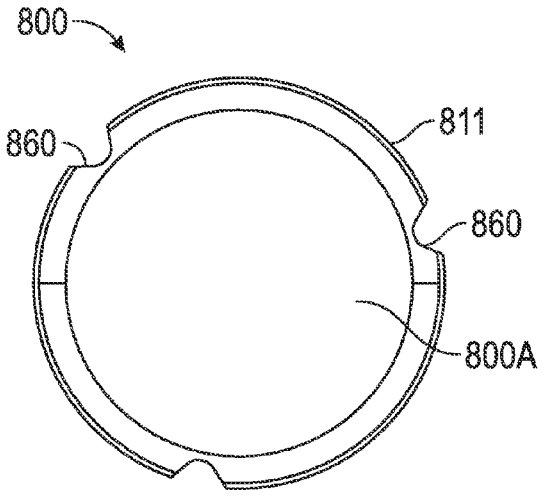
FIG. 19 is a bottom view of the insert of FIG. 18.

Referring now to FIGS. 18 and 19, an embodiment of an insert 800 for a rolling cone bit is shown. In general, insert 800 can be mounted at any suitable location on a rolling cone cutter of a rolling cone bit in the same manner as insert 100 previously described. Although insert 800 is believed to have particular utility as a bottomhole cutting element, it may also be employed as a heel cutting element or gage cutting element.

Insert 800 has a first or lower end 800*a*, a second or upper end 800*b*, a base portion 810 extending from lower end 800*a*, and a cutting portion 850 extending from upper end 800*b* to base portion 810. Base portion 810 has a central axis 815 and intersects cutting portion 850 at a reference plane of intersection 845 oriented perpendicular to axis 815. Cutting portion 850 extends from base portion 810 so as to define an extension height $H_{850}$ measured axially along axis 815 from base portion 810 to upper end 800*b*. Once mounted in a body of a cone cutter (e.g., body 51), the extension height $H_{850}$ of insert 800 is generally the distance from the surface of the cone cutter to the outermost point or portion of cutting portion 850 as measured perpendicular to the cone surface and generally parallel to axis 815.

In this embodiment, base portion 810 has a radially outer frustoconical surface 811 extending axially from lower end 800*a* to plane 845 and cutting portion 850. Surface 811 has an outer diameter $D_{810}$ that increases moving axially along base portion 810 from cutting portion 850 to lower end 800*a*. Outer surface 811 is preferably oriented at an angle $\alpha_{811}$ relative to axis 815 between 1.0° and 4.0°.

Outer surface 811 also includes a plurality of circumferentially-spaced elongate notches or recesses 860 extending axially from lower end 800*a* toward cutting portion 850. Thus, recesses 860 cut across outer surface 811. Unlike recesses 760 previously described, recesses 860 do not extend to cutting portion 850. In this embodiment, three parallel notches 860 uniformly angularly spaced 120° apart about axis 815 are provided. Each notch 860 is oriented parallel to axis 815.

Referring still to FIGS. 18 and 19, in this embodiment, cutting portion 850 has a chisel-shaped cutting surface 751 as previously described. Insert 800 is preferably mounted on a cone body such that a projection of crest median line 757 intersects the cone axis of rotation.

With insert 800 mounted to a cone body (e.g., cone body 51) with base portion 810 seated in a mating socket in the cone body and surrounded by the cone body, engagement of cone body and outer frustoconical surface 811 prevents insert 800 from moving axially (relative to axis 815) out of the mating socket, and thus, functions as an axial retention feature. In addition, engagement of notches 860 and the cone body prevent insert 800 from rotating about axis 815 relative to the cone body, and thus, function as torque holding features.

Although inserts 100, 300, 400, 500, 600, 700, 800 include chisel-shaped cutting portions 150, 350, 450, 550, 650, 750, 850, in generally, the axial retention features and/or rotational gripping features disclosed herein can be used in connection with an insert having any type of cutting portion (e.g., chisel-shaped, conical, dome-shaped, etc.). Further, although inserts 100, 300, 400, 500, 600, 700, 800 may have particular utility as bottomhole inserts, inserts having embodiments of axial retention features and/or rotational gripping features disclosed herein can be employed in any type of insert including, without limitation, heel inserts, gage inserts, nose inserts, etc.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An insert for a rolling cone drill bit, the insert having a first end and second end opposite the first end, the insert comprising:

a base portion having a central axis, wherein the base portion extends axially from the first end of the insert and is configured to be seated in a mating socket in a cone cutter of the rolling cone drill bit;

a cutting portion extending axially from the second end of the insert to the base portion and configured to engage an earthen formation;

wherein the base portion has a radially outer surface with respect to the central axis, the radially outer surface of the base portion including a first region extending axially from the cutting portion toward the first end of the insert;

wherein the first region of the radially outer surface of the base portion has a width measured perpendicular to the central axis in side view, wherein the width increases moving axially from the cutting portion, and wherein the first region of the radially outer surface of the base portion defines a non-cylindrical first axial retention feature configured to prevent the insert from moving axially out of the mating socket;

wherein the radially outer surface of the base portion further comprises a torque holding feature configured to prevent the insert from rotating about the central axis relative to the cone cutter;

wherein the torque holding feature of the base portion is distinct and separate from the first axial retention feature, and wherein the torque holding feature is adjacent the first axial retention feature and intersects the first axial retention feature along an edge.

2. The insert of claim 1, wherein the first region of the radially outer surface of the base portion comprises a frustoconical surface.

3. The insert of claim 1, wherein the torque holding feature is non-cylindrical.

4. The insert of claim 1, wherein the first axial retention feature comprises a planar surface disposed on the radially outer surface of the base portion;

wherein the planar surface is oriented at an acute angle relative to the central axis;

wherein the planar surface inclines towards the central axis moving along the planar surface towards the cutting portion.

5. The insert of claim 4, wherein the first axial retention feature comprises a plurality of circumferentially-spaced planar surfaces disposed about the radially outer surface of the base portion;

wherein each planar surface is oriented at an acute angle relative to the central axis;

wherein each planar surface inclines towards the central axis moving along the planar surface towards the cutting portion.

6. The insert of claim 1, wherein the first region of the radially outer surface includes a second axial retention feature;

wherein the first axial retention feature comprises a frustoconical surface;

wherein the second axial retention feature comprises a planar surface;

wherein the planar surface is oriented at an acute angle relative to the central axis;

wherein the planar surface inclines towards the central axis moving along the planar surface towards the cutting portion.

7. The insert of claim 1, wherein the torque holding feature comprises a planar surface.

8. The insert of claim 1, wherein the torque holding feature comprises a plurality of circumferentially-spaced planar surfaces disposed along the radially outer surface of the base portion.

9. The insert of claim 1, wherein the torque holding feature comprises an elongate notch extending along the radially outer surface of the base portion.

10. The insert of claim 9, wherein the notch is oriented parallel to the central axis.

11. The insert of claim 1, wherein the torque holding feature comprises a plurality of circumferentially-spaced elongate notches, each notch extending along the radially outer surface of the base portion.

12. The insert of claim 11, wherein each notch extends axially from the first end to the cutting portion.

13. The insert of claim 1 wherein radially outer surface of the base portion further includes a second region axially positioned between the first region and the first end;

wherein the second region comprises a radially extending dimension that does not change along the central axis.

14. The insert of claim 13, wherein the radially outer surface of the base portion further includes a notch extending axially along the second region.

15. A rolling cone drill bit for drilling a borehole in earthen formations, the bit comprising:

a bit body having a bit axis;

a rolling cone cutter rotatably mounted on the bit body, wherein the cone cutter has a cone axis of rotation;

a plurality of inserts mounted to the cone cutter, each insert comprising:

a base portion having a central axis, wherein the base portion is seated in a mating socket in the cone cutter;

a cutting portion extending from the base portion and the cone cutter, wherein the cutting portion is configured to engage the earthen formation;

wherein the base portion has a radially outer surface including a first region extending axially from the cutting portion;

wherein the first region of the radially outer surface of the base portion is a frustoconical surface having an outer diameter that increases moving axially from the cutting portion, and wherein the frustoconical surface defines a non-cylindrical axial retention feature configured to prevent the insert from moving axially out of the mating socket.

16. The insert of claim 15, wherein the radially outer surface of the base portion further comprises a non-cylindrical torque holding feature configured to prevent the insert from rotating relative to the cone cutter; and wherein the torque holding feature extends axially along the radially outer surface of the base portion.

17. The insert of claim 16, wherein the torque holding feature comprises a plurality of circumferentially-spaced planar surfaces extending along the radially outer surface of the base portion.

18. The insert of claim 17, wherein the planar surfaces incline towards the central axis moving toward the cutting portion.

19. The insert of claim 16, wherein the torque holding feature comprises a plurality of circumferentially-spaced elongate notches.

20. The insert of claim 19, wherein the each notch extends axially along the first region of the radially outer surface towards the cutting portion.

21. The insert of claim 15, wherein the radially outer surface of the base portion further includes a second region extending axially from first region;

wherein the second region of the radially outer surface comprises a cylindrical surface.

22. The insert of claim 21, wherein the radially outer surface further includes a torque holding feature comprising a plurality of circumferentially-spaced notches in the second region.

23. The insert of claim 22, wherein each notch extends axially from second region, through the first region, and to the cutting portion.

* * * * *